US006651391B2

(12) United States Patent
Nale

(10) Patent No.: US 6,651,391 B2
(45) Date of Patent: Nov. 25, 2003

(54) SHROUD FOR SEPTIC TANK ACCESS OPENING

(76) Inventor: Melvin Travis Nale, 3 Martin Ave., Waterville, ME (US) 04901

( * ) Notice: Subject to any disclaimer, the term of this patent is extended or adjusted under 35 U.S.C. 154(b) by 0 days.

(21) Appl. No.: 10/034,700

(22) Filed: Dec. 28, 2001

(65) Prior Publication Data

US 2003/0121216 A1 Jul. 3, 2003

(51) Int. Cl.[7] ..... E02D 29/14

(52) U.S. Cl. ..... 52/20; 52/19; 52/21; 52/169.6; 220/761

(58) Field of Search ..... 52/20, 19, 21, 52/169.6, 169.8; 220/694, 315, 327, 324, 761, 797

(56) References Cited

U.S. PATENT DOCUMENTS

| | | | | | |
|---|---|---|---|---|---|
| 1,923,481 | A | * | 8/1933 | Ford | 137/13 |
| 2,607,727 | A | * | 8/1952 | Butler | 52/20 |
| 3,728,464 | A | * | 4/1973 | Griffing | 52/20 |
| 3,850,801 | A | * | 11/1974 | Pearson | 210/86 |
| 4,089,139 | A | * | 5/1978 | Moffa et al. | 52/20 |
| 4,097,380 | A | * | 6/1978 | Carlson | 210/261 |
| 4,913,095 | A | * | 4/1990 | Morrow et al. | 119/28 |
| 5,431,553 | A | * | 7/1995 | Topf, Jr. | 52/20 |
| 5,511,897 | A | * | 4/1996 | House et al. | 52/20 |
| 5,553,712 | A | * | 9/1996 | Tisbo et al. | 220/761 |
| 5,727,901 | A | * | 3/1998 | Rennie et al. | 405/45 |
| 5,772,361 | A | * | 6/1998 | Gavin | 52/20 |
| 6,276,552 | B1 | * | 8/2001 | Vervisch | 220/324 |
| 6,371,688 | B1 | * | 4/2002 | Yang et al. | 52/20 |

* cited by examiner

*Primary Examiner*—Carl D. Friedman
*Assistant Examiner*—Nahid Amiri
(74) *Attorney, Agent, or Firm*—David & Bujold, PLLC

(57) ABSTRACT

A shroud for use in combination with a septic tank having an access opening and an access cover. The shroud surrounds the access opening and facilitates removal of the access cover covering the access opening and providing access to the septic tank. The shroud comprises a contiguous sidewall opened at first and second opposed ends thereof with an access passageway extending therebetween. A first open end of the shroud has an annular surface for abutting engagement with a top surface of a septic tank. A retaining member retains the annular surface, at the first end of the shroud, in abutting engagement with the top surface of the septic tank. A removable shroud cover seals the second open end of the shroud and the shroud cover, when removed from the second end of the shroud, facilitates access an interior cavity of the septic tank.

19 Claims, 5 Drawing Sheets

SHROUD FOR SEPTIC TANK ACCESS OPENING

FIELD OF THE INVENTION

The present invention relates to a shroud, for surrounding an access opening of a septic tank covered by an access cover, to facilitate easy access to the access opening of the septic tank when necessary, e.g. for service, maintenance or periodic pumping of the septic tank.

BACKGROUND OF THE INVENTION

As is well known and conventional in the art, a septic tank is typically buried underground, e.g. buried a foot or so underground in a leach field or some other suitable location. Periodically, the septic tank requires maintenance, service or fails and thus has to be "pumped out". The biggest problem associated with servicing or pumping out a septic tank is locating the access opening covered by the access cover which typically both are buried under a foot or so of earth, gravel, dirt, etc. As is generally the case, since the access cover (which may be either round, square, rectangular, etc.) is hidden from view by earth, gravel, dirt, etc., the landowner has to rely on his/her memory in an attempt to locate the access opening and the access cover to allow service or pumping out of the septic system. The problem of locating a septic tank access opening and access cover is compounded when a new landowner purchases the home or other building having the septic tank and new owner does not know the specific location of the septic tank or is only vaguely familiar with the general location of the septic tank.

SUMMARY OF THE INVENTION

Wherefore, it is an object of the present invention to overcome the above mentioned shortcomings and drawbacks associated with accessing an access opening and access cover of a septic tank.

Another object of the present invention is to provide a shroud, for encompassing the access opening and the cover access of a septic tank, to facilitate easy location of the access cover, when necessary, to allow access to the septic tank for servicing, pumping or other maintenance thereof.

A further object of the present invention is to provide a shroud cover which precisely marks the exact location of the access opening and the access cover of the buried septic tank.

Yet another object of the present invention is to provide a sufficient seal between the mating shroud and an upwardly facing surface of the septic tank to minimize the possibility of any liquid from the environment leaking or seeping between the shroud and septic tank seal and contaminating the septic tank.

A further object of the present invention is to provide a sufficient seal between the second end of the shroud and the shroud cover to minimize the possibility of any liquid from the environment leaking or seeping between the shroud and shroud cover and contaminating the septic tank.

A still further object of the present invention is to provide a strong, durable, maintenance-free shroud and shroud cover which can readily withstand the elements and last for prolong periods of time, e.g. forty or fifty years or so, without any required maintenance.

The present invention also relates to a shroud for surrounding an access opening of a septic tank to facilitate removal of an access cover covering the access opening and providing access to the septic tank, the shroud comprising: a contiguous sidewall being opened at first and second opposed ends thereof and an access passageway extending between the first and second openings, and the first end of the shroud having an annular surface for abutting engagement with a top surface of a septic tank; and a removable shroud cover for sealing the second end of the shroud and the shroud cover, when removed from the second end of the shroud, facilitating access to the access cover of the septic tank to provide access to an interior compartment of the septic tank.

The present invention also relates to a method of surrounding an access opening of a septic tank with a shroud to facilitate removal of an access cover covering the access opening and providing access to the septic tank, the method comprising the steps of: forming a contiguous sidewall opened at first and second opposed ends thereof and forming an access passageway extending between the first and second openings, and the first end of the shroud having an annular surface for abutting engagement with a top surface of a septic tank; and providing a removable shroud cover for sealing the second open end of the shroud; and when access to an interior compartment of the septic tank is desired, removing the shroud cover, from the second end of the shroud, to facilitate access to the access cover of the septic tank.

BRIEF DESCRIPTION OF THE DRAWINGS

The invention will now be described, by way of example, with reference to the accompanying drawings in which.

DETAILED DESCRIPTION OF THE INVENTION

Figure 1:
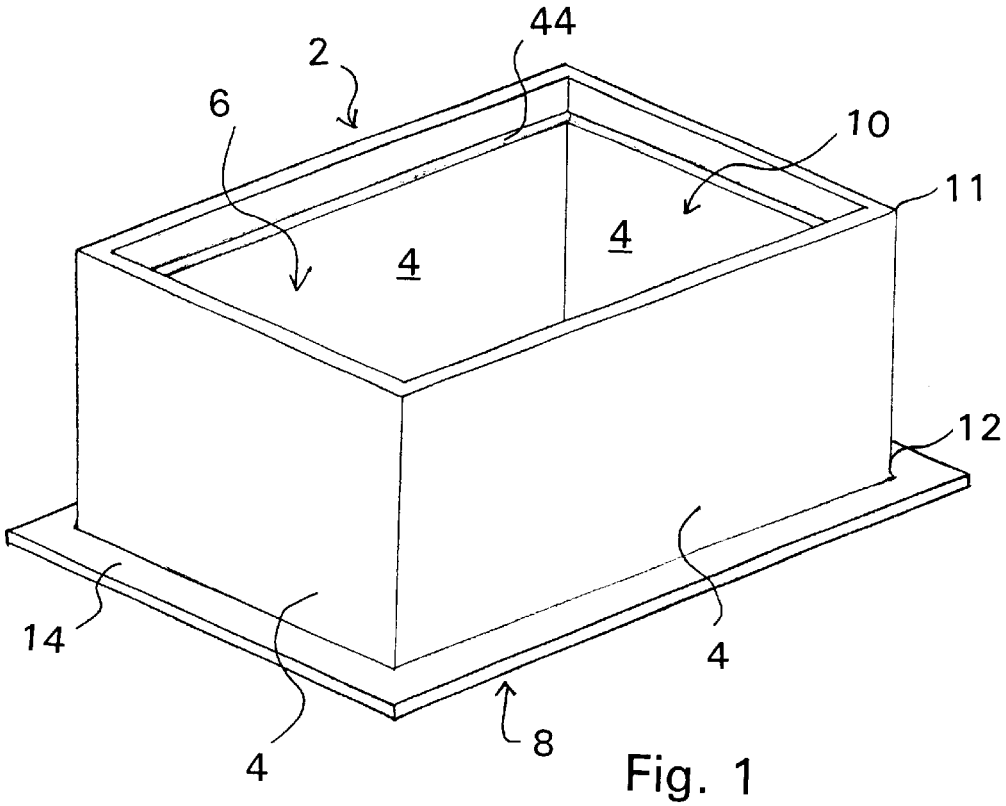
FIG. 1 is a diagrammatic perspective view-of a first embodiment of a shroud for use in encasing an access opening and access cover of a septic tank.
Figure 2:
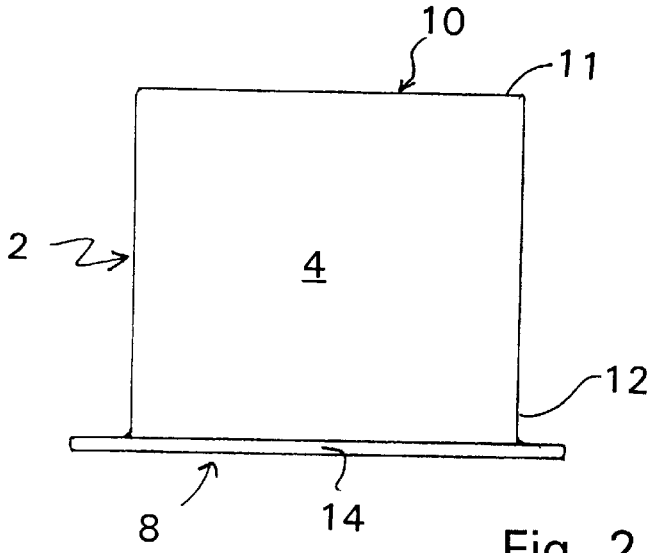
FIG. 2 is a front elevational view of the shroud of FIG. 1.

Turning now to FIGS. 1 and 2, a brief description concerning a first embodiment of a shroud 2, according to the present invention, will now be provided. As can be seen in this Figure, the shroud 2 generally comprises four (4) rectangular shaped sidewalls 4 which are interconnected with one another to form an integral, contiguous surface and define a square transverse access passageway 6 therein. The sidewalls 4 typically have a length of between 10 inches and 24 inches and a width of between 8 inches and 26 inches and more preferably, the sidewalls have a length of between 18 inches and 20 inches and a width of between 13 inches and 14 inches. The first and second opposed open ends 8,10 of the access passageway 6 are open and the purpose of such opening ends will be discussed in further detail below.

A first bottom portion 12 of each sidewall 4 of the shroud 2 has a flange 14 integrally formed therewith. The flange 14 extends substantially normal to each sidewall 4 and has a length of between ½ inches and 8 inches. More preferably, the flange 14 extends around the entire periphery of the shroud 2 and has a length of between 2 inches and 4 inches.

The access passageway 6, defined by the sidewalls 4, preferably has width dimension which is suitably sized to completely encompass both an access opening 20 and an access cover 22 of a conventional septic tank 24 and allow manipulation thereof by an individual desiring to access to an internal cavity 26 of the septic tank 24. Conventional septic tank access covers 22 typically have width dimensions of between 8 inches and 24 inches and length (or diameter) dimensions of between 12 inches and 30 inches. Accordingly, the opposed sidewalls 4 should be spaced from one another by a distance of at least one inch greater than the dimension of the access cover 22 to provide easy access and manipulation of the access cover 22 when desired.

Figure 3:
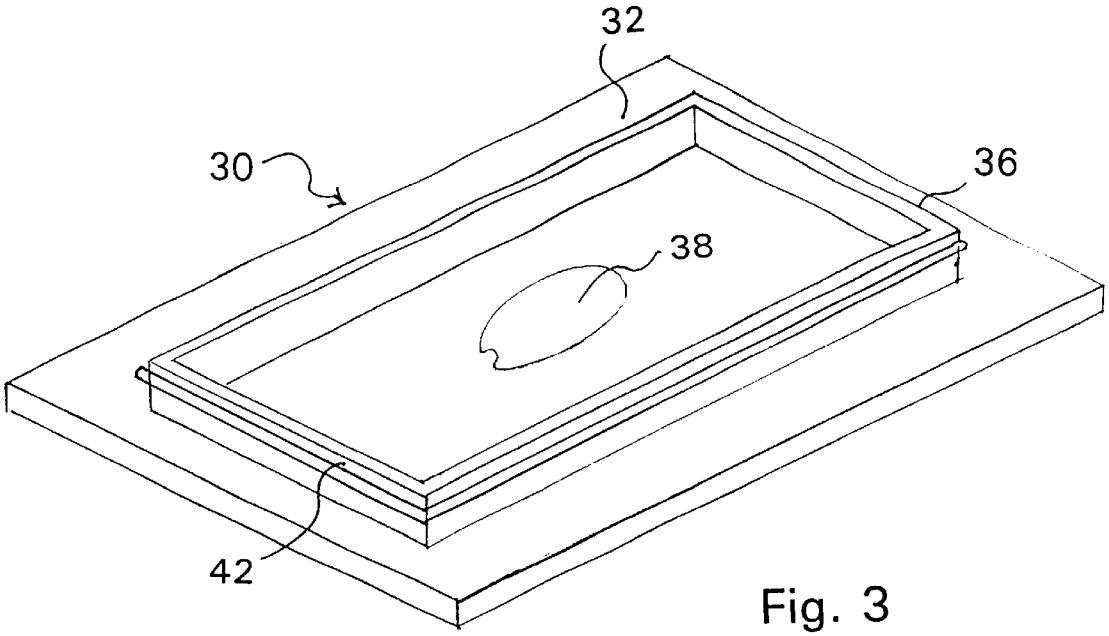
FIG. 3 is a diagrammatic bottom perspective view of a shroud cover for covering the top open end of the shroud of FIG. 1.
Figure 4:
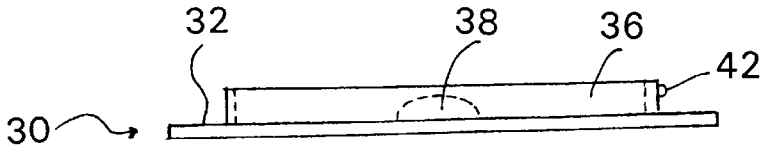
FIG. 4 is a diagrammatic front elevational view of the shroud cover of FIG. 3.
Figure 5:
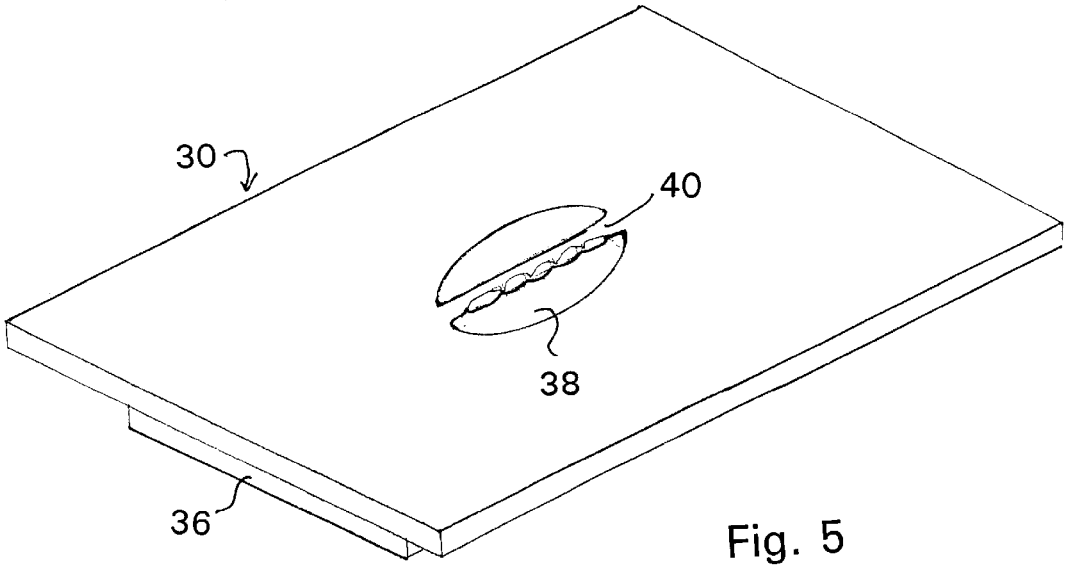
FIG. 5 is a diagrammatic top perspective view of the shroud cover of FIG. 3.
Figure 6:
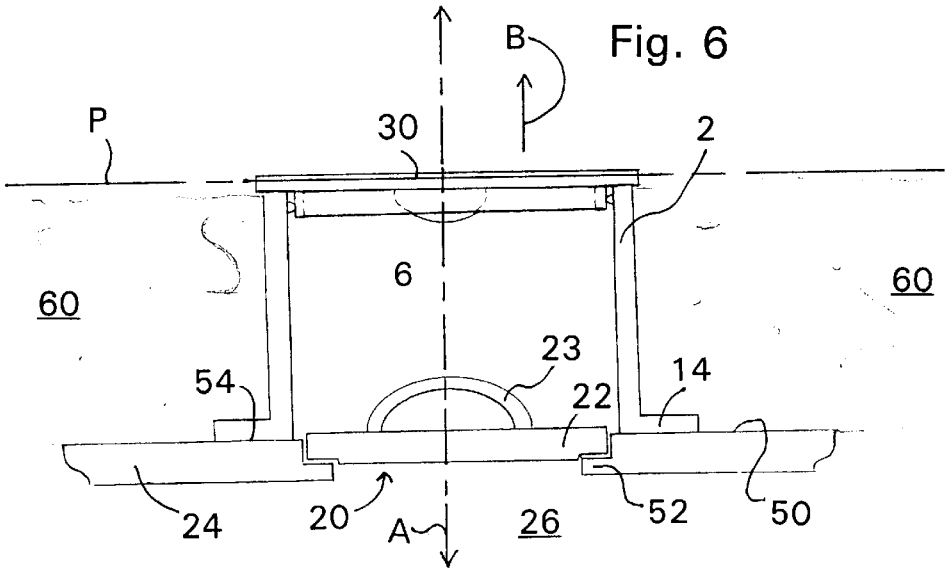
FIG. 6. is a digrammatic cross sectional view showing installation of the shroud and shroud cover, according to the first embodiment, to facilitate marking of the access opening and the access cover for accessing the septic tank when necessary.

Turning now to FIGS. 3–5, a detailed description concerning a shroud cover 30 for use in combination with the shroud 2 will now be discussed in detail.

As can be seen in these Figures, the shroud cover 30 has a base 32 which is generally planar and has a rectangular shape. The shroud cover 30 is sized to be slightly larger than the second opening 10 formed in the second end surface 11 of the shroud 2, i.e. the shroud cover 30 should be at least a quarter to a half inch or so larger in size than the second opening 10 defined by the second end surface 11 of the shroud 2 to ensure that the shroud cover 30 is retained by the perimeter end surface of the shroud 2 and does not inadvertently fall into the access passageway 6 defined by the shroud 2.

As can be seen in FIG. 4, a retaining ledge 36 extends from a bottom downwardly facing surface of the base 32 of the shroud cover 30 and the retaining ledge 36 typically has a height of between ⅛ inch and 8 inches, more preferably a height of between ½ inch and 2 inches. The retaining ledge 36 has an outer perimeter dimension which is slightly smaller in size than the surface area of the second opening 10 of the shroud 2 and the retaining ledge 36 functions as a retention mechanism or member for the shroud cover 30. That is, the shroud cover 30 is placed over the second opening 10 of the shroud 2 so that the retaining ledge 36 is received within the second opening 10 of the shroud 2. During such receiving engagement, the shroud cover 30 will slightly overlap the second end surface 11 of the shroud 2 while the retaining ledge 36 will prevent, or minimized at the very least, any lateral shifting motion of the shroud cover 30 relative to the shroud 2 to maintain the shroud cover 30 in its installed position. If desired, the outwardly facing top surface of the shroud cover 30 covered with a decorative material, e.g. AstroTurf® to provide a grass-like appearance, can be covered with gravel to simulate a dirt-like appearance, can be textured, can be painted a decorative color, can be contoured, etc., depending upon the desire appearance of the end user.

As can be seen in FIGS. 3 and 5, a central region of the base 32 of the shroud cover 30 is partially recessed, at 38, which an elongate central area is not recessed and forms a shroud handle 40 which facilitates grasping of the shroud cover 32 and removal of the same from the second end 10 of the shroud 2.

The recess 38 should only be an inch or so deep and approximately 3 or so inches wide to provide adequate room to accommodate the fingers of an end user while minimizing the amount of liquid, water or other debris which may collect in the recess.

To facilitate a secure engagement between the shroud cover 30 and the shroud 2, the outwardly facing surface of the annular ledge 36 can be provided with a first protrusion or some other first component 42 of a conventional interlocking system while the inwardly facing surface of the second end 11 of the shroud 2 can be provided with a mating recess 44 or some other mating second component of the conventional interlocking system. In the event that the shroud cover 30 is provided with the first locking component 42 and the shroud is provided with the second mating locking component 44, the locking components 42, 44 of the shroud 2 and the shroud cover 30 facilitate a more secure and water tight seal between those two components and minimizes the possibility of extraneous liquid, water, debris and other components entering into the access passageway.

Now that the basic components of the shroud 2 and shroud cover 30 have been described in detail, a typical installation for the same will now be discussed. As is conventional in the art, the septic tank 24 has an access opening 20 formed in a top surface 50 of the septic tank 24. An annular lip 52 projects inwardly from the top surface 50 of the septic tank 24 and defines and surrounds the access opening 20. The annular lip 52 forms a seating surface and prevents the access cover 22 from completely entering into the internal cavity 26 defined by the septic tank 24. As the size, shape and function of the septic tank 24 are well known is the art, and for no part of the invention per se, a further discussion concerning the same is not provided.

When a septic tank 24 is installed or when a malfunctioning septic tank is removed and replaced with a new septic tank, the septic tank 24 is generally placed in the ground in a conventional manner, e.g. by a crane, a hoist or the like. The septic tank 24 is then generally checked to ensure that it is level and that access cover 22 is proper positioned over the access opening 20. The necessary plumbing is also connect to the septic tank 24. Then shroud 2 is then positioned on the top surface 50 of the septic tank 24 so as to circumscribe and completely surround the access opening 20 and the access cover 22. The flange 14 of the shroud 2 is placed so as to abut flushly against an upwardly facing top surface 50 of the septic tank 24. The flange 14 can be either sealed in place, by use of a silicone adhesive, or some other conventional adhesive 54. Alternatively, earth or gravel 60 may be placed around the shroud 2 and on top of the flange 14 so that the weight of the earth or gravel 60 biases the shroud 2 into a continuous sealing engagement with the upwardly facing top surface 50 of the septic tank 24 to maintain those two mating components in constant sealing engagement with one another. Once sufficient backfilling of earth or gravel 60 has occurred around the exterior periphery of the shroud 2, such backfilling securely affixes the shroud 2 to the septic tank 24 so that the shroud 2 essentially becomes integral therewith.

Prior to completing the backfilling of the shroud, the shroud cover 30 is placed over the second opening 10 of the shroud 2 to seal the access passageway 6 of the shroud 2 and ensure that the none of the backfilling earth or gravel 60 falls into the access passageway 6. The backfilling excavation proceeds until the level of the backfilled earth or gravel 60 lies generally in a plane P defined by the shroud cover 30. Following such backfilling, the shroud cover 30 will function as a marker which easily and quickly identifies, for an end user, the exact location of the access opening and the access cover of the septic tank as well and the generally location of the septic tank.

In the event that service or routine maintenance of the septic tank is a required, the end user merely has to walk over to the shroud cover 30 and remove the same by grasping the handle 40 of the shroud cover 30 and initially lift the shroud cover 30 in the direction of arrow B, along a longitudinal axis A defined by the shroud 2, until the shroud cover 30 is raised a sufficient distance so that the retaining ledge 36 is removed from the second open end 10 of the shroud 2. Thereafter, the shroud cover 30 can be manipulated, in any desired manner, by the end user desiring access to the septic tank 24. Generally the shroud cover 30 is placed on the ground, adjacent the shroud 2, following removal from the shroud 2.

Next, the end user reaches inside the access passageway 6 of the shroud 2 with his or her hand and grasps one or both cover handles 23 of the access cover 22 and lifts the access cover 22 generally along the longitudinal axis A, in the direct of arrow B, to remove the access cover 22 from both the access opening 20 of the septic tank 24 and the shroud 2. Once this is completed, the end user can access the septic tank 24 to provide the desired maintenance, service or attend to any other matter requiring attention at this time.

Following completion of the maintenance, service, etc., the end user then repositions the access cover 22 over the access opening 20 so that the access cover 22 rests on the annular lip 52 and seals the access opening 20 of the septic tank 24. Thereafter, the end user places the shroud cover 30 over the second open end 10 of the shroud 2 to seal the second opening of the shroud 2. Following replacement of the access cover 22 and the shroud cover 30, the shroud 2 and shroud cover 30 function to provides a liquid tight seal or barrier which prevents extraneous water, liquid, contaminants, debris, etc., from entering into the septic tank via the access opening 20. Nevertheless, the combined shroud cover 30 and shroud 2 mark the exact location of the access opening 20 and provide easy access to the access cover 22 of the septic tank 24 when service, maintenance or routine pumping of the septic tank is required.

Figure 7:
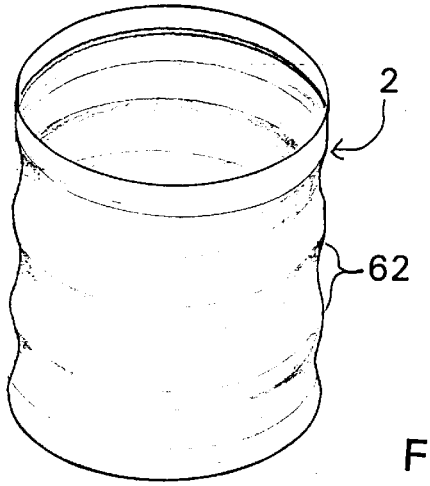
FIG. 7 is a diagrammatic perspective view of a second embodiment of a shroud for use in encasing an access opening and an access cover of a septic tank.
Figure 8:
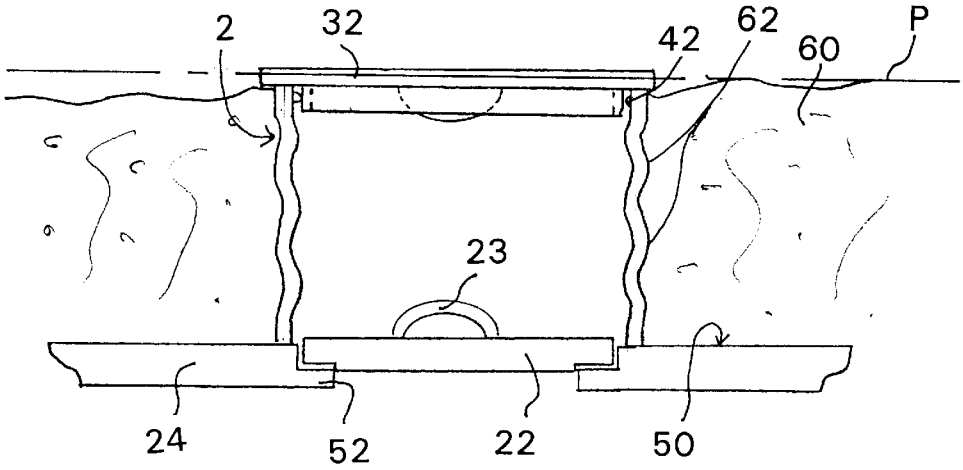
FIG. 8 is a diagrammatic cross sectional view showing installation of the shroud and shroud cover, according to the second embodiment, to facilitate marking of the access opening and the access cover for accessing the septic tank when necessary.

It is to be appreciated that a variety of other retaining arrangements can be utilized for maintaining the shroud in proper engagement with the top surface 50 of the septic tank 24. For example, as shown in FIGS. 7 and 8, the exterior sidewall 4 of the shroud 2 is generally cylindrical in shape and is provided with a wavy or corrugated exterior surface 62. That is, the exterior surface 62 of the shroud 2 has a plurality of regular or irregular undulations formed therein so that when the shroud 2 is positioned on the top surface 50 of the septic tank 24 and backfilled with earth or gravel 60, the earth or gravel 60 will settle against the wavy or corrugated exterior surface of the shroud 2 and retain the shroud 2 in its installed position and prevent removal thereof from its placed position on the top surface 50 of the septic tank 24.

Figure 9:
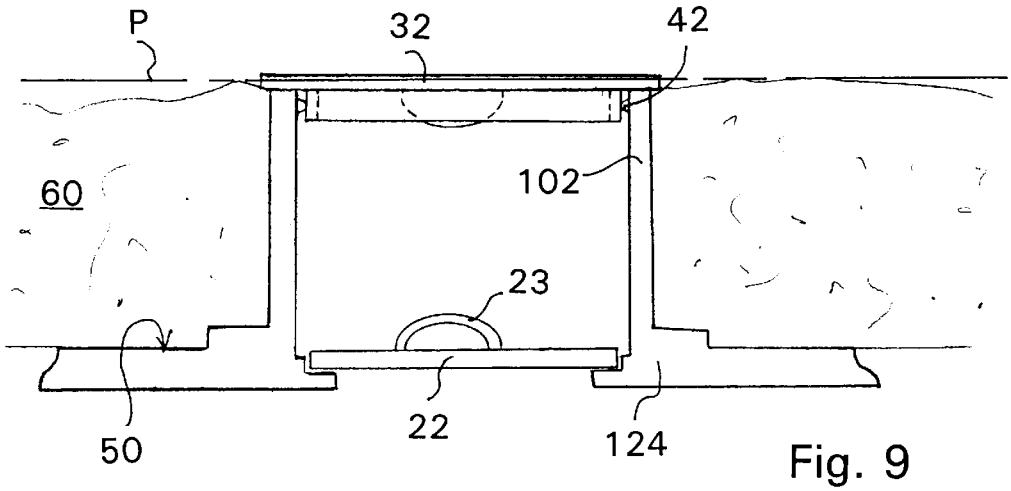
FIG. 9 is a diagrammatic cross sectional view showing installation of a shroud and shroud cover, according to a third embodiment, to facilitate marking of the access opening and the access cover for accessing the septic tank when necessary.

With reference to FIG. 9, a third embodiment of the present invention will now be discussed. According to this embodiment, the shroud 102 is formed integral with the septic tank 124, i.e. it is an extension of the septic tank which extends from the top surface 50 of the septic tank 124 about the perimeter of the access opening 20. This arrangement ensures a fluid tight seal is formed between the first end of the shroud 102 and the top surface 50 of the septic tank 124 as these two components are integrally formed with one another. As with the previous embodiments, the shroud cover 30 will cover the second open end 10 of the shroud 102. In addition, mating first and second locking components 42, 44 may be provided to facilitate a secure engagement between the shroud cover 30 and the second opening 10 of the shroud 102. Depending upon the adequacy of the seal obtained between the shroud cover 30 and the shroud 102, with this embodiment it may not be necessary to provide an access cover 22 for the septic tank 24, in addition to the shroud cover 32.

Figure 11:
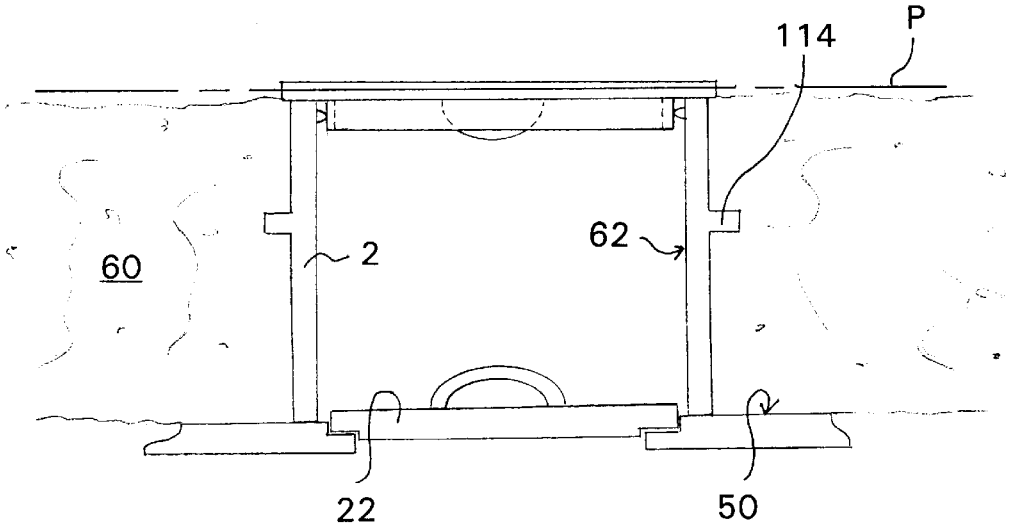
FIG. 11 is a diagrammatic cross sectional view showing installation of the shroud and shroud cover, according to the fourth embodiment, to facilitate marking of the access opening and the access cover for accessing the septic tank when necessary.
Figure 10:
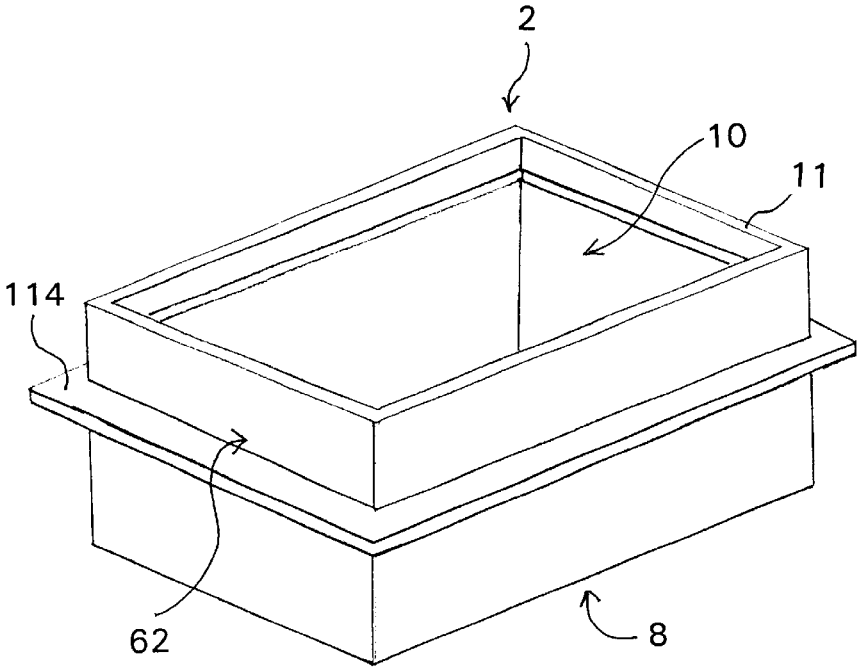
FIG. 10 is a digrammatic perspective view of a fourth embodiment of a shroud for use in encasing an access opening and access cover of a septic tank.

With reference now to FIGS. 10 and 11 a fourth embodiment of the present Invention will now be discussed. As the embodiment is very similar to the first embodiment, only the variation between this embodiment and the first embodiment will be discussed In detail. The basic different between this embodiment and the first embodiment is the location of the flange 114. According to this embodiment, the flange 114 circumscribes an intermediate portion or region 62 of the exterior surface of the shroud 2 and extends substantially perpendicular thereto. As with the first embodiment, once sufficient backfilling of earth or gravel 60 covers the flange 114 provided on the intermediate portion of the shroud 2, the flange 114 assists with maintaining the abutment surface located at the first end of the shroud 2 in an abutting engagement with the top surface 50 of the septic tank 24.

It is to be appreciated that while FIGS. 1 through 5 show the shroud having a square or rectangular transverse dimension, other shapes, e.g. cylindrical, oval, oblong, etc., are all possible and fall within the spirit and scope of the present invention. Preferably a synthetic material, such as polypropylene or polyester, for example or possibly a metal such as aluminum, stainless steel, etc.,can be used to manufacture the shroud for the first, second and fourth embodiments as well as the shroud cover for all four embodiments. Alternatively, the shroud and shroud cover can be manufactured from cast concrete, as with the third embodiment. Typically the shroud 2 and shroud cover 32 will have a wall thickness of between 1/16 inch and 4 inches, preferably a wall thickness of between ¼ inch and 1 inch.

While a plastic material is desirable for manufacturing the shroud and shroud cover, due to longevity and ease of manufacture, it is to be appreciated that the shroud and the shroud cover can be manufactured from a variety of other materials such as metal, fiberglass, composite resins, etc. The important criteria is that the shroud and shroud cover must be weather resistant, durable and resist cracking or breakage.

Since certain changes may be made in the above described shroud and shroud cover, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A shroud for surrounding an access opening of a septic tank to facilitate removal of an access cover covering the access opening and providing access to the septic tank, the shroud comprising:

a contiguous sidewall only being opened at opposed first and second ends thereof and an access passageway extending between a the open first and second ends of the shroud, the open first end of the shroud having an annular surface for abutting engagement with a top surface of a septic tank, and the open first end being sufficiently large in size so as to completely encompass the accedes opening of the septic tank;

a removable shroud cover for sealing the open second end of the shroud and facilitating access to the access cover of the septic tank, via the access passageway, to provide access to an interior compartment of the septic tank;

a retaining member retains the annular surface, located at the first end of the shroud, in abutting engagement with the top surface of the septic tark; and the retaining member comprises a flange secured to the first end of the shroud, adjacent the surface for abutting the top surface of the septic tank, and the flange extends around the entire perimeter of the shroud substantially perpendicular to the sidewall of the shroud.

2. The shroud according to claim 1, wherein the flange has a width of between ½ inches and 8 inches.

3. The shroud according to claim 1, wherein the retaining member further comprises at least one undulation formed in an exterior surface of the sidewall of the shroud.

4. A shroud for surrounding an access opening of a septic tank to facilitate removal of an access cover covering the access opening and providing access to the septic tank, the shroud comprising:

a contiguous sidewall only being opened at opposed first and second ends thereof and an access passageway extending between the open first and second ends of the shroud, the open first and of the shroud having an annular surface for abutting engagement with a top surface of a septic tank, and the open first end being sufficiently large in size so as to completely encompass the access opening of the septic tank;

a removable shroud cover for sealing the open second end of the shroud and facilitating access to the access cover of the septic tank via, the access passageway, to provide access to an interior compartment of the septic tank; and an adhesive secures the annular surface of the shroud against the top surface of the septic tank to provide a secured attachment therebetween.

5. The shroud according to claim 1, wherein the shroud cover has a shroud handle which facilitates removal of the shroud cover by an end user to provide access to the access passageway.

6. The shroud according to claim 1, wherein the shroud cover has a shroud handle at least partially formed via a recess formed in the shroud cover, and the shroud handle facilitates removal of the shroud cover by an end user to provide access to the access passageway.

7. The shroud according to claim 1, wherein the shroud cover is slightly larger in dimension than a dimension of the second end of the shroud so that the shroud cover overlaps the second end of the shroud to provide a sealing engagement between the shroud cover and the shroud.

8. The shroud according to claim 1, wherein an inwardly facing surface of the shroud cover has a retaining ledge which extends into the access passageway defined by the shroud, and the retaining ledge prevents the shroud cover from moving excessively lateral with respect to the shroud but allows vertical movement of the shroud cover relative to the shroud to facilitate removal of the shroud cover from the shroud.

9. The shroud according to claim 7, wherein the shroud cover is provided with a first interlocking component and the shroud is provided with a second mating interlocking component, and the first and second interlocking components facilitate a fluid tight seal between the shroud cover and the shroud.

10. The shroud according to claim 1, wherein the shroud cover has a shroud handle which facilitates removal of the shroud cover by an end user to provide access to the access passageway; and the shroud cover is slightly larger in dimension than a dimension of the second end of the shroud so that the shroud cover overlaps the second end of the shroud to provide a sealing engagement between the shroud cover and the shroud.

11. The shroud according to claim 10, wherein an inwardly facing surface of the shroud cover has a retaining ledge which extends into the access passageway defined by the shroud, and the retaining ledge prevents the shroud cover from moving excessively lateral with respect to the shroud but allows vertical movement of the shroud cover relative to the shroud to facilitate removal of the shroud cover from the shroud.

12. The shroud according to claim 11, wherein the shroud cover is provided with a first interlocking component and the shroud is provided with a second mating interlocking component, and the first and second interlocking components facilitate a fluid tight seal between the shroud cover and the shroud.

13. A shroud in combination with a septic tank having an access opening, the shroud surrounding the access opening to facilitate removal of an access cover covering the access opening and providing access to the septic tank, the shroud comprising:

a contiguous sidewall being opened at opposed first and second ends thereof and an access passageway extending between the open first and second ends;

a retaining member for retaining the shroud in abutting engagement with the top surface of the septic tank; and a removable shroud cover for sealing the second end of the shroud and the shroud cover, when removed from the second end of the shroud, facilitating access to the septic tank to provide access to an internal cavity thereof.

14. The shroud according to claim 13, wherein an inwardly facing surface of the shroud cover has a retaining ledge which extends into the access passageway defined by the shroud, and the retaining ledge prevent; the shroud cover from moving excessively lateral with respect to the shroud but allows vertical movement of the shroud cover relative to the shroud to facilitate removal of the shroud cover from the shroud; and the shroud cover is provided with a first interlocking component and the shroud is provided with a second mating interlocking component, and the first and second interlocking components facilitate a fluid tight seal between the shroud cover and the shroud.

15. The shroud according to claim 14, wherein the shroud cover has a shroud handle which facilitates removal of the shroud cover by an end user to provide access to the access passageway; and the shroud cover is slightly larger in dimension than a dimerision of a the second end of the shroud so that the shroud cover overlaps the second end of the shroud to provide a sealing engagement between the shroud cover and he shroud.

16. A method of surrounding an access opening of a septic tank with a shroud to facilitate removal of an access cover covering the access opening and providing access to the septic tank, the method comprising he steps of;

forming a contiguous sidewall opened at opposed first and second ends thereof and forming an access passageway extending between the open first and second ends, and the first end of the shroud having an annular surface for abutting engagement with a top surface of a septic tank; and providing a removable shroud cover for sealing the open second end of the shroud; and when access to an internal cavity of the septic tank is desired, removing the shroud cover, from the second end of the shroud, to facilitate access to the access cover of the septic tank.

17. The shroud according to claim 4, wherein the shroud cover has a shroud handle which facilitates removal of the shroud cover by an end user to provide access to the access passageway.

18. The shroud according to claim 4, wherein the shroud over has a shroud handle at least partially formed via a recess formed in the shroud cover, and the shroud handle facilitates removal of the shroud cover by an end user to provide access to the access passageway.

19. The shroud according to claim 4, wherein the shroud cover is slightly larger in dimension than a dimension of the second end of the shroud so that the shroud cover overlaps the second end of the shroud to provide a sealing engagement between the shroud cover and the shroud.

* * * * *